US007712443B2

(12) United States Patent
Gemein

(10) Patent No.: US 7,712,443 B2
(45) Date of Patent: May 11, 2010

(54) SWITCHABLE CAM FOLLOWER OF A VALVE TRAIN OF AN INTERNAL COMBUSTION ENGINE

(75) Inventor: Stefan Gemein, Fuerth (DE)

(73) Assignee: Schaeffler KG, Herzogenaurach (DE)

( * ) Notice: Subject to any disclaimer, the term of this patent is extended or adjusted under 35 U.S.C. 154(b) by 345 days.

(21) Appl. No.: 11/997,784

(22) PCT Filed: Jul. 8, 2006

(86) PCT No.: PCT/EP2006/006702

§ 371 (c)(1),
(2), (4) Date: Feb. 4, 2008

(87) PCT Pub. No.: WO2007/017027

PCT Pub. Date: Feb. 15, 2007

(65) Prior Publication Data

US 2008/0245326 A1 Oct. 9, 2008

(30) Foreign Application Priority Data

Aug. 5, 2005 (DE) ..... 10 2005 037 053

(51) Int. Cl.
*F01L 1/18* (2006.01)

(52) U.S. Cl. ..... 123/90.39; 123/90.16; 74/559

(58) Field of Classification Search ..... 123/90.15, 123/90.19, 90.39; 74/559
See application file for complete search history.

(56) References Cited

U.S. PATENT DOCUMENTS 5,544,626 A 8/1996 Diggs
6,314,928 B1 * 11/2001 Baraszu et al. ..... 123/90.16
6,325,030 B1 12/2001 Spath et al.
2005/0132990 A1 6/2005 Haas et al.

FOREIGN PATENT DOCUMENTS

| | | | |
|---|---|---|---|
| DE | 197 00 316 | Y | 7/1997 |
| DE | 101 58 703 | Y | 7/2002 |
| DE | 102 11 038 | A | 11/2002 |
| DE | 102 57 705 | Y | 6/2004 |
| DE | 10 2004 007766 | A | 9/2004 |
| DE | 103 08 995 | A | 9/2004 |
| DE | 103 10 968 | Y | 9/2004 |
| EP | 0 733 783 | A | 9/1996 |
| EP | 13 67 228 | Y | 12/2003 |
| FR | 2 733 539 | A | 10/1996 |
| WO | 2004/053303 | A | 6/2004 |

* cited by examiner

*Primary Examiner*—Zelalem Eshete
(74) *Attorney, Agent, or Firm*—Lucas & Mercanti, LLP

(57) ABSTRACT

The invention relates to a switchable cam follower of a valve train of an internal combustion engine, comprising an outer follower and an inner follower interposed between the lateral walls thereof. A roller extends between arms of the inner follower, float-mounted on a pin, as the counter face for an eccentric disk. The followers are disposed on one end on a common axis. On the distal end, they have elongate seats that, at the base of the cam, are mutually aligned. A coupling element is located in the seat of the outer follower and can be displaced step by step into the seat (here follower surface) of the inner follower. The pin on the inner follower slightly projects over the arms of the inner follower with one projection each. When coupled, upper sides of the projections rest against lower sides of stop surfaces that are mounted on the inner surfaces of the lateral walls of the outer follower.

7 Claims, 1 Drawing Sheet

SWITCHABLE CAM FOLLOWER OF A VALVE TRAIN OF AN INTERNAL COMBUSTION ENGINE

FIELD OF THE INVENTION

The invention relates to a switchable cam follower of a valve train of an internal combustion engine, having an outer lever and having an inner lever which is arranged between the side walls of said outer lever, which inner lever has between its arms a roller, which is mounted on a journal, as a mating running face for a lifting cam, with a rest for a gas-exchange valve being intrinsic to the cam follower at an underside at one end, and a pivot bearing being intrinsic to the cam follower at an underside at the other end, with the levers at one of the ends running on a common axle and having, at an end remote from the axle, longitudinally extending receptacles which are aligned with one another in the cam base circle, with a coupling means being arranged in at least one of the receptacles, which coupling means, for coupling the levers, is movable in sections into the opposite receptacle.

BACKGROUND OF THE INVENTION

In order to produce an aligned position of receptacles for coupling means in the cam base circle in levers which are already known from the prior art, a respective outer lever has a stop which engages in the manner of a bracket under the corresponding inner lever approximately in the region of the transverse central plane. On account of the necessary transition radii of said bracket-like stop from the arms of the outer lever as viewed in the transverse direction, a cam follower of said type has to be of relatively wide construction, since the inner lever cannot come into contact with an upper side of the transverse bracket in the radii region. If, nevertheless, there is contact in the region of the radii, unnecessarily high material loading is to be expected. States can also occur in which there is not sufficient alignment of the coupling means with respect to the opposite receptacle, with the result that coupling cannot be realized.

Secondly, it is obvious that, on account of the transverse bracket which engages over the underside of the inner lever, the cam follower is of unnecessarily deep construction. Here, problems can occur with free movement in the region of the cylinder head.

It is also disadvantageous that the journal for the roller as a mating running surface must be calked in the inner lever or fastened to the inner lever in some other way. This increases the production expenditure. In addition, the roller with journal cannot be disassembled again after the initial fastening. A disassembly would however be desirable for servicing purposes or in the event of a pairing of pre-sorted rollers for play adjustment.

OBJECT OF THE INVENTION

It is therefore an object of the invention to create a cam follower of the above-mentioned generic type, in which the described disadvantages are eliminated.

ACHIEVEMENT OF THE OBJECT

According to the invention, said object is achieved in that the journal is mounted in a "floating" fashion in the inner lever and, with one extension each, extends marginally beyond the arms of the inner lever, with upper sides of the extensions bearing, in the coupled state, against undersides of stop faces which are formed on inner faces of the side walls of the outer lever.

The above-described disadvantages are therefore eliminated. The scope of protection of this invention also relates to solutions for switchable drag levers in which what is known as "transverse locking" is applied. On account of the internal stop measures which preferably proceed in one piece from inner faces of side walls of the outer lever, the above-mentioned bracket-like stop which engages under the inner lever can be dispensed with. The journal for the roller is accordingly of marginally wider design than the inner lever, so that the upper sides thereof bear in a simple fashion against undersides of the stop faces in the coupled state. Alignment of the receptacles for the coupling means is therefore provided in the cam base circle. At the same time, said stop measures can realize a freedom of movement of the mating running face of the inner lever in the cam base circle in relation to its cam. As a result of the latter measure, structural redundancy is avoided and, at the same time, base circle friction is reduced.

The term "floating" is intended to mean an arrangement of the journal in the corresponding receptacle in the inner lever which dispenses with any form of fastening. The journal is therefore self-centering by way of its outer end sides against inner faces of the side walls of the outer lever.

Undersides of the stop faces, which can, if appropriate, also be formed separately, are expediently realized so as to be complementary to upper sides of the journal.

Instead of the "lifting switchover means" provided as a cam follower, it is also possible for a "lifting switch-off means" to be provided, that is to say, in the decoupled state, the lever parts would not cause the gas exchange valve to open.

The stop faces expediently project only marginally inward from the inner faces of the side walls of the outer lever. In further refinement of the invention, it is additionally provided that the stop faces proceed in one piece from upper sides of the side walls of the outer lever. Said stop faces can also be formed in one piece with mating running faces for low-lift cams, which mating running faces can be embodied as sliding faces, so that a T-shaped or T-like profile is provided in cross section in said region. It is however also provided to arrange the stop faces to be deeper at a distance from said upper sides.

The scope of protection also encompasses a solution in which rollers as mating running faces are likewise applied to the outer lever, or in which rollers as mating running faces are provided only on the outer lever, and the inner lever is provided with a sliding face.

The proposed lost motion spring is of relatively compact construction. In addition, as a result of contact of its one leg against an upper side of a transverse web of the outer lever in the decoupled state, an "unscrewing prevention mechanism" for the inner lever in the cylinder head direction is created, in such a way that the journal cannot get lost.

Instead of the rotary leg spring as a lost motion spring, it is also possible, if appropriate, to use coil pressure springs or the like. Consideration is given in particular to a spherical cap as a pivot bearing for the cam follower. The cam follower can be mounted on a head of a hydraulic or mechanical support element by means of said spherical cap. Also conceivable and provided if appropriate, however, is an arrangement of the cam follower on a pivot axle or the like.

One particularly expedient variant of a supply of hydraulic medium to the cam follower in order to move the coupling device in at least one direction is provided when the hydraulic medium is conducted via the head of the support element, the pivot bearing and a short hydraulic medium duct directly into the receptacle for the coupling means. Here, the cam follower can be provided so as to be either mechanically locked or mechanically unlocked in the unpressurized state.

It is possible, if appropriate, for further means for acting on the at least one piston as coupling means to also be provided on the cam follower according to the invention, for example a means which is hydraulic at both sides, an electromagnetic means, a magnetic means and the like.

BRIEF DESCRIPTION OF THE DRAWINGS

The invention is expediently explained in more detail on the basis of the drawing, in which.

DETAILED DESCRIPTION OF THE DRAWINGS

Figure 1:
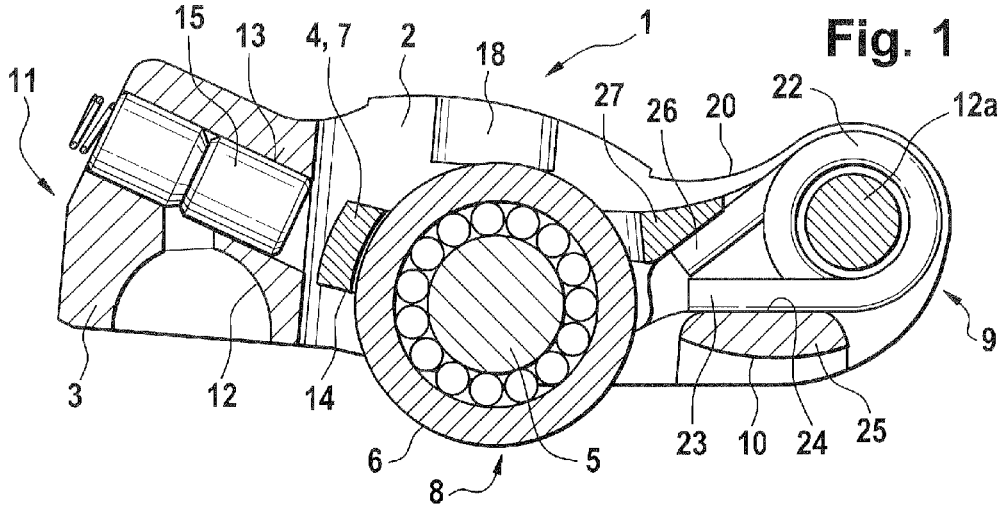
FIG. 1 shows a longitudinal section through a cam follower according to the invention.
Figure 2:
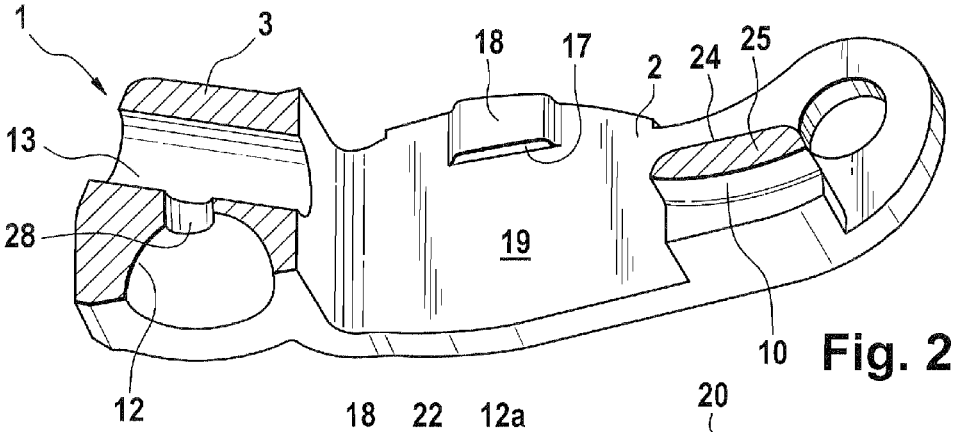
FIG. 2 shows a longitudinal section through the outer lever of said cam follower and FIG. 3 shows a cross section through the cam follower in the region of its journal in the direction of the rest for the gas-exchange valve.

The figures disclose a switchable cam follower 1 for a valve train of an internal combustion engine. Said cam follower 1 has an outer lever 3. Mounted between side walls 2 of the outer lever 3 is an inner lever 4. Said inner lever 4 has two spaced-apart arms 7, between which runs a roller as a mating running face 6 for a high-lift cam. Said roller is in this case mounted by means of rolling bodies on a journal 5 which runs in a "floating" manner, that is to say not fastened, in the inner lever 4.

The outer lever 3 has, on an underside 8 at one end 11, a pivot bearing 12 which is embodied as a spherical cap. By means of said pivot bearing 12, said outer lever 3 can be mounted, so as to be pivotably movable, on a head of a for example hydraulic support element. At the other end 9, the outer lever 3 has, on the underside 8, a transverse web 25 with a rest 10 for a gas-exchange valve. If appropriate, the cam follower 1 can also be designed to serve to open a plurality of equivalent gas exchange valves.

It can also be seen that the outer lever 3 has, above the pivot bearing 12, a receptacle 13 which runs in the longitudinal direction here. Seated in this receptacle 13 in the decoupled state is a for example piston-like coupling means 15. Arranged at the other end 9 is an axle 12*a* on which the levers 3, 4 run so as to be pivotably movable relative to one another.

Figure 3:
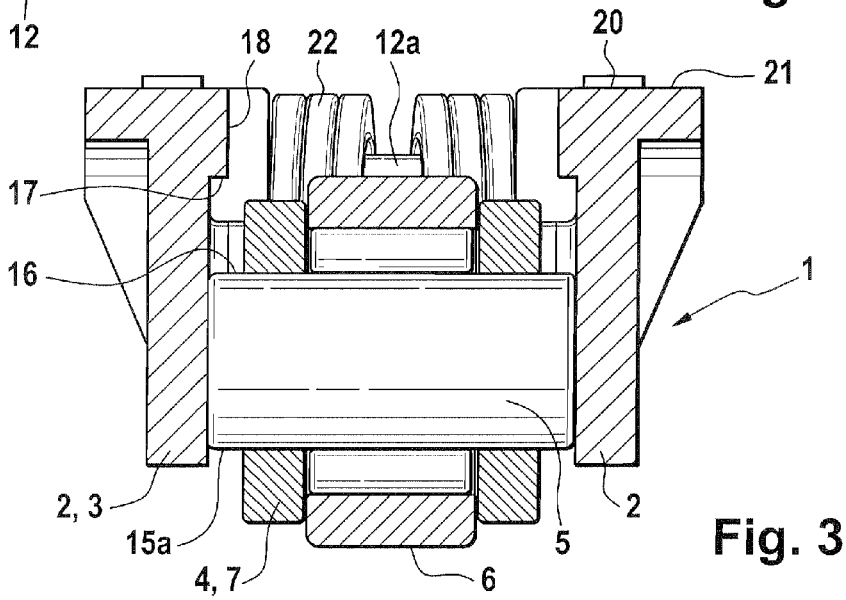

As is illustrated in particular in FIG. 3, a rotary leg spring 22 as a lost motion spring is arranged on the axle 12*a* within the arms 7 of the inner lever 4. The at least one leg 23 (see also FIG. 1) of said rotary leg spring 22 is in this case supported on an upper side 24 of said transverse web 25. The other leg 26 of said rotary leg spring 22 acts against a transverse beam 27 of the inner lever 4. A return of the inner lever 4 into its decoupled state on its high-lift cam is thereby ensured.

It can also be seen (see in particular FIG. 3) that upper sides 20 of the side walls 2 of the outer lever 3, at least in the region of a center, project outward in the manner of segments so as to form sliding faces as mating running faces 21 for cams. Said mating running faces 21 form stop faces 18 which project in sections and slightly inward from inner faces 19 of the side walls 2.

The journal 5 projects with its extensions 15*a* at both ends slightly beyond the arms 7 of the inner lever 4. In order to create an aligned position of the receptacle 13 with respect to a receptacle 14 on an underside of the inner lever 4, upper sides 16 of the extensions 15*a* of the journal 5 bear against complementary undersides 17 of the stop faces 18, with a coupling in a bore likewise being conceivable here. As it passes through the cam base circle, the mating running face 6, which is embodied as a roller, of the inner lever 4 is out of contact with the cam, with the above-mentioned mating running faces 21 on the outer lever 3 being supported against their cams.

LIST OF REFERENCE SYMBOLS

1 Rocker arm
2 Side wall
3 Outer lever
4 Inner lever
5 Journal
6 Mating running face
7 Arm
8 Underside
9 End
10 Rest
11 End
12 Pivot bearing
12*a* Axle
13 Receptacle
14 Receptacle
15 Coupling means
15*a* Extension
16 Upper side
17 Underside
18 Stop face
19 Inner face
20 Upper side
21 Mating running face
22 Rotary leg spring
23 Leg
24 Upper side
25 Transverse web
26 Leg
27 Transverse beam
28 Hydraulic medium duct

The invention claimed is:

1. A switchable cam follower of a valve train of an internal combustion engine, comprising: an outer lever and having an inner lever which is arranged between the side walls of said outer lever, which inner lever has between its arms a roller, which is mounted on a journal, as a mating running face for a lifting cam, with a rest for a gas-exchange valve being intrinsic to the cam follower at an underside at one end, and a pivot bearing being intrinsic to the cam follower at an underside at the other end, with the levers at one of the ends running on a common axle and having, at an end remote from the axle, longitudinally extending receptacles which are aligned with one another in the cam base circle, with a coupling means being arranged in at least one of the receptacles, which coupling means, for coupling the levers, is movable in sections into the opposite receptacle, wherein the journal is mounted in a "floating" fashion in the inner lever and, with one extension each, extends marginally beyond the arms of the inner lever, with upper sides of the extensions bearing, in the coupled state, against undersides of stop faces which are formed on inner faces of the side walls of the outer lever.

2. The cam follower as claimed in claim 1, wherein the stop faces proceed in one piece from upper sides of the side walls of the outer lever, with the undersides thereof being complementary to the extensions of the journal.

3. The cam follower as claimed in claim 2, wherein each side wall of the outer lever is formed at its upper side in one piece with a projecting, segment-like sliding face as a mating running face for a further lifting cam, which mating running face, with a smooth surface, projects inward in sections from the upper side so as to form the corresponding stop face.

4. The cam follower as claimed in claim 1, wherein each side wall of the outer lever is formed at its upper side with a sliding face as a mating running face for a respective low-lift cam, and the roller in the inner lever is formed as a mating running face for a high-lift cam, with either the mating running face of the inner lever or the mating running faces of the outer lever being contact-less in the cam base circle.

5. The cam follower as claimed in claim 1, wherein the rest for the gas-exchange valve and the pivot bearing are arranged on the outer lever, with the axle running on the side of the rest.

6. The cam follower as claimed in claim 5, wherein the axle is surrounded, between the arms of the inner lever, by at least one rotary leg spring as a lost motion spring, with the leg at one end of said rotary leg spring acting against an upper side of a transverse web of the outer lever, which transverse web has the rest for the gas-exchange valve at the other side, and with the leg at the other end of said rotary leg spring engaging under a transverse beam of the inner lever, which transverse beam, in the longitudinal direction of the lever as viewed from the axle, is arranged in front of the roller as a mating running face.

7. The cam follower as claimed in claim 1, wherein the pivot bearing is embodied as a spherical cap for resting against a head of a mechanical or hydraulic support element, with the receptacle for the coupling means being arranged above the pivot bearing in the region of a longitudinal central axis of the cam follower and, at least if a hydraulic support element is used, being intersected by a hydraulic medium duct which proceeds from the pivot bearing.

* * * * *